US008998346B2

(12) United States Patent
Hall et al.

(10) Patent No.: US 8,998,346 B2
(45) Date of Patent: Apr. 7, 2015

(54) ATTACK TOOL WITH AN INTERRUPTION

(71) Applicants: David R. Hall, Provo, UT (US); Ronald B. Crockett, Payson, UT (US); John Bailey, Spanish Fork, UT (US); Jeff Jepson, Spanish Fork, UT (US)

(72) Inventors: David R. Hall, Provo, UT (US); Ronald B. Crockett, Payson, UT (US); John Bailey, Spanish Fork, UT (US); Jeff Jepson, Spanish Fork, UT (US)

( * ) Notice: Subject to any disclaimer, the term of this patent is extended or adjusted under 35 U.S.C. 154(b) by 0 days.

(21) Appl. No.: 13/919,749

(22) Filed: Jun. 17, 2013

(65) Prior Publication Data

US 2014/0368023 A1 Dec. 18, 2014

(51) Int. Cl.

| | |
|---|---|
| ***E21C 35/18*** | (2006.01) |
| ***E21C 35/183*** | (2006.01) |
| ***E02F 9/28*** | (2006.01) |

(52) U.S. Cl.
CPC ..... *E21C 35/183* (2013.01); *E02F 9/2866* (2013.01); *E02F 9/2808* (2013.01)

(58) Field of Classification Search
USPC ..... 299/79.1, 100–11, 112 R, 112 T, 113; 175/425, 426, 428, 430–432, 434, 435
See application file for complete search history.

(56) References Cited

U.S. PATENT DOCUMENTS 3,830,321 A * 8/1974 McKenry et al. ..... 175/332

* cited by examiner

*Primary Examiner* — Sunil Singh
(74) *Attorney, Agent, or Firm* — Philip W. Townsend, III

(57) ABSTRACT

In one aspect of the present invention, a tool has a wear-resistant steel base comprising a shank suitable for attachment to a driving mechanism. A planar end of a cemented metal carbide segment brazed to an interfacial surface of the base axially opposed to the shank. At least one interruption is formed in the interfacial surface.

13 Claims, 10 Drawing Sheets

ATTACK TOOL WITH AN INTERRUPTION

CROSS REFERENCE TO RELATED APPLICATIONS

The present application is a divisional of U.S. patent application Ser. No. 11/766,903 filed on Jun. 22, 2007 and entitled "Attack Tool with an Interruption." U.S. patent application Ser. No. 11/766,903 is a continuation of U.S. patent application Ser. No. 11/766,865 filed on Jun. 22, 2007 entitled "Attack Tool with an Overhang." U.S. patent application Ser. No. 11/766,865 is a continuation-in-part of U.S. patent application Ser. No. 11/742,304 which was filed on Apr. 30, 2007 and issued as U.S. Pat. No. 7,475,948 entitled "Pick with a Bearing." U.S. patent application Ser. No. 11/742,304 is a continuation of U.S. patent application Ser. No. 11/742,261 which was filed on Apr. 30, 2007 and issued as U.S. Pat. No. 7,469,971 entitled "Lubricated Pick." U.S. patent application Ser. No. 11/742,261 is a continuation-in-part of U.S. patent application Ser. No. 11/464,008 which was filed on Aug. 11, 2006 and issued as U.S. Pat. No. 7,338,135 entitled "Holder for a Degradation Assembly." U.S. patent application Ser. No. 11/464,008 is a continuation-in-part of U.S. patent application Ser. No. 11/463,998 which was filed on Aug. 11, 2006 and issued as U.S. Pat. No. 7,384,105 entitled "An Attack Tool." U.S. patent application Ser. No. 11/463,998 is a continuation-in-part of U.S. patent application Ser. No. 11/463,990 which was filed on Aug. 11, 2006 and issued as U.S. Pat. No. 7,320,505 entitled "Attack Tool." U.S. patent application Ser. No. 11/463,990 is a continuation-in-part of U.S. patent application Ser. No. 11/463,975 which was filed on Aug. 11, 2006 and issued as U.S. Pat. No. 7,445,294 entitled "Attack Tool." U.S. patent application Ser. No. 11/463,975 is a continuation-in-part of U.S. patent application Ser. No. 11/463,962 which was filed on Aug. 11, 2006 and issued as U.S. Pat. No. 7,413,256 entitled "Washer for a Degradation Assembly." The present application is also a continuation-in-part of U.S. patent application Ser. No. 11/695,672 which was filed on Apr. 3, 2007 and issued as U.S. Pat. No. 7,396,086 entitled "Press-Fit Pick." U.S. patent application Ser. No. 11/695,672 is a continuation-in-part of U.S. patent application Ser. No. 11/686,831 filed on Mar. 15, 2007 and issued as U.S. Pat. No. 7,568,770 entitled "Superhard Composite Material Bonded to a Steel Body." All of these applications are herein incorporated by reference for all that they contain.

BACKGROUND OF THE INVENTION

The present invention relates to an improved cutting element or insert that may be used in machinery such as crushers, picks, grinding mills, roller cone bits, rotary fixed cutter bits, earth boring bits, percussion bits or impact bits, and drag bits.

U.S. Pat. No. 6,733,087 to Hall, et al., which is herein incorporated by reference for all that it contains, discloses an attack tool for working natural and man-made materials that is made up of one or more segments, including a steel alloy base segment, an intermediate carbide wear protector segment, and a penetrator segment comprising a carbide substrate that is coated with a superhard material, The segments are joined at continuously curved surfaces vary from one another at about their apex in order to accommodate ease of manufacturing and to concentrate the bonding material in the region of greatest variance. The carbide used for the penetrator and the wear protector may have a cobalt binder, or it may be binderless. It may also be produced by the rapid omnidirectional compaction method as a means of controlling grain growth of the fine cobalt particles. The parts are brazed together in such a manner that the grain size of the carbide is not substantially altered. The superhard coating may consist of diamond, polycrystalline diamond, cubic boron nitride, binderless carbide, or combinations thereof.

BRIEF SUMMARY OF THE INVENTION

In one aspect of the present invention, a tool has a wear-resistant steel base comprising a shank suitable for attachment to a driving mechanism. A planar end of a cemented metal carbide segment is brazed to an interfacial surface of the base axially opposed to the shank. The interfacial surface of the base has a diameter smaller than a base diameter of the carbide segment.

A superhard tip may be bonded to the cemented metal carbide segment and may have a diameter larger than an upper diameter of the carbide segment. The superhard tip may be brazed to the cemented metal carbide with a braze comprising a thickness of 1.0 to 50 microns. The superhard tip may comprise a material selected from the group consisting of polycrystalline diamond, vapor-deposited diamond, natural diamond, cubic boron nitride, infiltrated diamond, layered diamond, diamond impregnated carbide, diamond impregnated matrix, silicon bonded diamond, or combinations thereof. A braze used between the planar end of the cemented metal carbide segment and the interfacial surface of the base may comprise silver, gold, copper, nickel, palladium, boron, chromium, silicon, germanium, aluminum, iron, cobalt, manganese, titanium, tin, gallium, vanadium, indium, phosphorus, molybdenum, platinum, zinc, or combinations thereof. The braze may also comprise a thickness of 0.001 to 0.010 inch.

The base diameter of the carbide segment may overhang the diameter of the interfacial surface by 0.001 to 0.100 inch. The outside diameter of the carbide segment may be grinded down 0.010 to 0.050 inch. Further, the outside diameter of the carbide segment may be grinded down 0.020 to 0.030 inch. A portion of the base may be inserted into a pocket formed within the carbide segment. The cemented metal carbide segment may comprise a concave surface.

In another aspect of the present invention, a method has steps for assembling an attack tool. A superhard tip has a diamond piece bonded to a carbide substrate and a wear-resistant steel base has a shank. An interfacial surface of the base and a base surface of the superhard tip are brazed to opposite surfaces of a cemented metal carbide segment. An overhang is formed between the carbide segment and the steel base; the interfacial surface of the base having a diameter smaller than a base diameter of the carbide segment. The superhard tip may also overhang the carbide segment at the interface at which they are brazed together; the superhard tip having a base diameter greater than the diameter of the upper surface of the carbide segment. The base diameter of the superhard tip may be grinded down 0.001 to 0.010 inch. The overhang formed by the carbide segment may be grinded down 0.010 to 0.050 inch. It is believed that grinding down the outer diameters of the carbide segments may increase the wear life of the attack tool. At least one interruption may be formed within the interfacial surface of the base. The overhang may have a concave or a convex region. Also, a portion of the overhang may be covered with a stop-off material.

In another aspect of the invention, at least one interruption is formed in the interfacial surface. The interruption may have a plurality of notches formed within the interfacial surface. The steel base may be formed by forging, machining, or a combination thereof. A supporting piece may be press fit into the at least one interruption. The supporting piece may comprise a hard material selected from the group consisting of carbide, chromium, tungsten, tantalum, niobium, titanium, molybdenum, natural diamond, polycrystalline diamond, vapor deposited diamond, cubic boron nitride, TiN, AlNi, AlTiNi, TiAlN, CrN/CrC/(Mo, W)S2, TiN/TiCN, AlTiN/MoS2, TiAlN, ZrN, diamond impregnated carbide, diamond impregnated matrix, silicon bonded diamond, or combinations thereof. The press fit may have an interference of 0.0005 to 0.0050 inch. The cemented metal carbide segment and/or the base may comprise a concave surface. The plurality of interruptions may have various geometries and dimensions. Some embodiments may comprise circular and/or rectangular geometries.

The at least one interruption may comprise a width of 5 to 75 percent the width of the interfacial surface of the base. In some embodiments, the width of the interruption may be 35 to 55 percent of the width of the interfacial surface. The at least one interruption may also comprise a depth of 10 to 75 percent of a body portion of the base. In some embodiments, the depth is 25 to 55 percent of a body portion of the base. At least one interruption may be formed in the planar end of the cemented metal carbide segment.

DETAILED DESCRIPTION OF THE INVENTION AND THE PREFERRED EMBODIMENT

Figure 1:
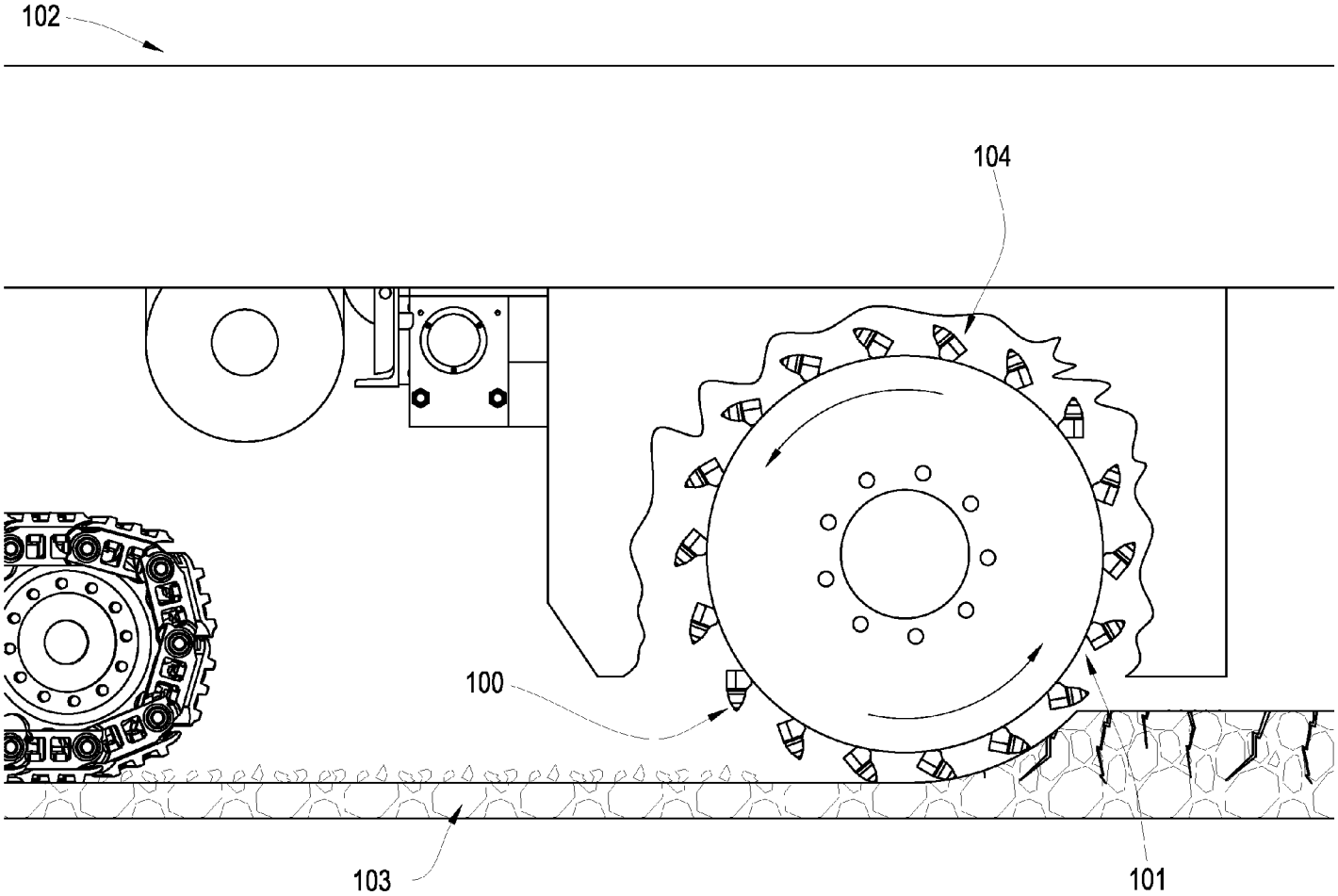
FIG. 1 is a cross-sectional diagram of an embodiment of attack tools on a rotating drum attached to a motor vehicle.

FIG. 1 is a cross-sectional diagram of an embodiment of a plurality of attack tools 100 attached to a rotating drum 101 connected to the underside of a pavement milling machine 102. The milling machine 102 may be a cold planar used to degrade man-made formations such as pavement 103 prior to the placement of a new layer of pavement. Picks 100 may be attached to the drum 101 bringing the attack tools 100 into engagement with the formation. A holder 104 may be attached to the rotating drum 101 and the tool 100 may be inserted into the holder 104. The holder 104 may hold the tool 100 at an angle offset from the direction of rotation, such that the tool 100 engages the pavement at a preferential angle.

Figure 3:
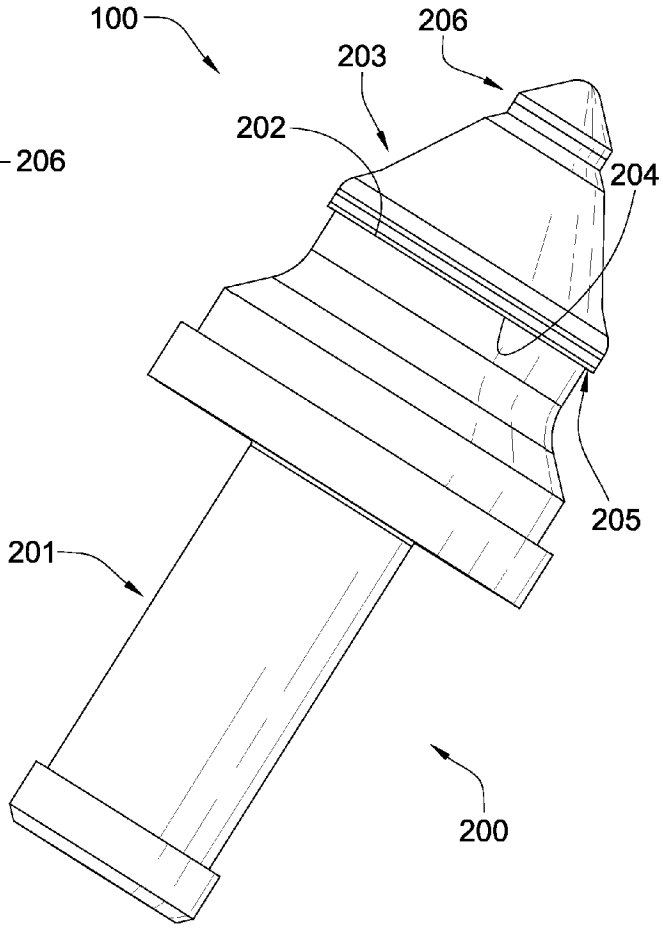
FIG. 3 is a perspective diagram of another embodiment of an attack tool.
Figure 2:
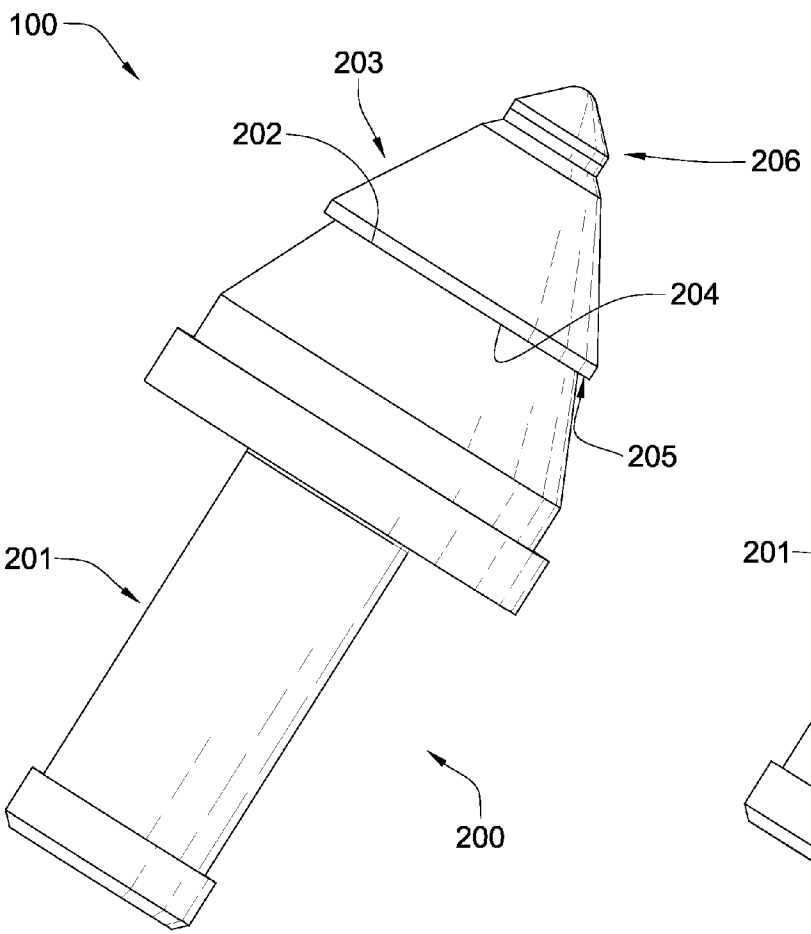
FIG. 2 is a perspective diagram of an embodiment of an attack tool.

FIGS. 2 and 3 show two embodiments of an attack tool 100 having a wear-resistant steel base 200 with a shank 201 suitable for attachment to a driving mechanism. A planar end 202 of a cemented metal carbide segment 203 may be brazed to an interfacial surface 204 of the base 200 axially opposed to the shank 201. The interfacial surface 204 of the base 200 may have a diameter smaller than a base diameter of the carbide segment 203, thus forming an overhang 205. It is believed that having the overhang 205 may improve the life of the attack tool 100. An outside diameter of the carbide segment 203 may be grinded down 0.010 to 0.050 inch in order to smooth over cracks that may have been formed in the surface of the carbide during manufacturing. This may also increase the life as well as increase the efficiency of the attack tool 100. A superhard tip 206 may be bonded to the cemented metal carbide segment 203. In the preferred embodiment, the tip 206 may be brazed to the carbide segment 203. The superhard tip may comprise a carbide substrate bonded to a harder material. The harder material selected from the group consisting of polycrystalline diamond, vapor-deposited diamond, natural diamond, cubic boron nitride, infiltrated diamond, layered diamond, diamond impregnated carbide, diamond impregnated matrix, silicon bonded diamond, or combinations thereof. In some embodiments, the steel base may comprise hard-facing to increases its wear resistance. In some embodiment the tool may comprise a washer comprising a layer of hardfacing.

Figure 4:
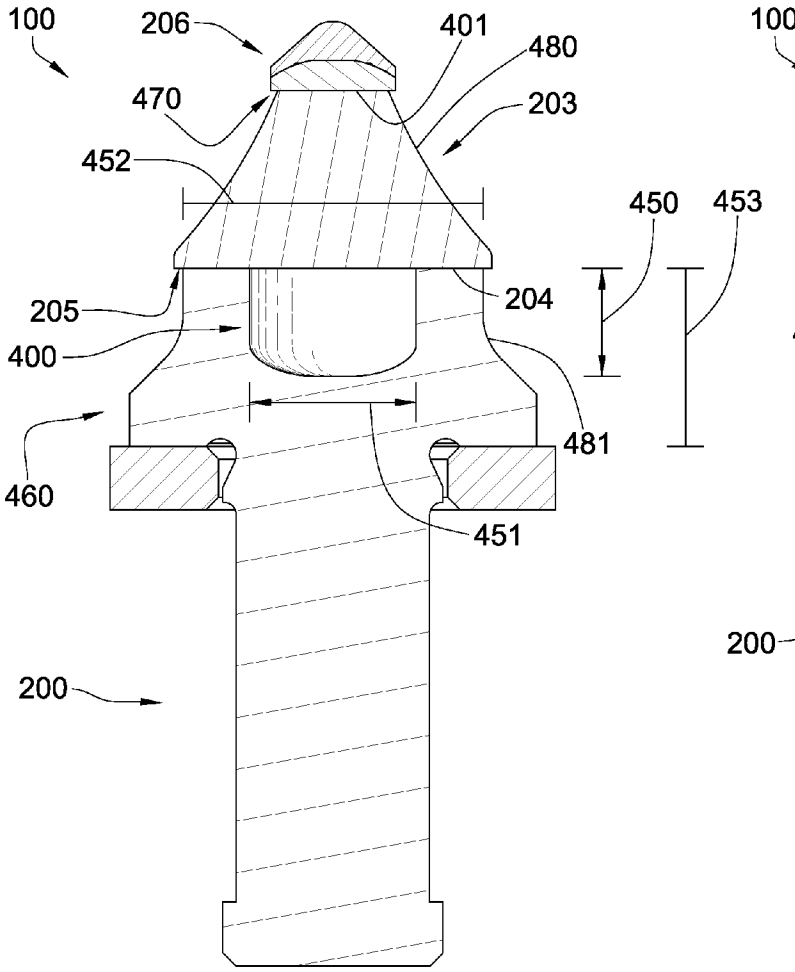
FIG. 4 is a cross-sectional diagram of another embodiment of an attack tool.

FIGS. 4 through 9 illustrate cross-sectional diagrams of various embodiments of an attack tool 100. In some embodiments, at least one interruption 400 may be formed in the interfacial surface 204 of the base 200 and the interfacial surface 204 may have a diameter smaller than a base diameter of the carbide segment 203, forming an overhang 205 as shown in FIG. 4. The cemented metal carbide segment 203 may be brazed to the steel base 200 with a braze comprising silver, gold, copper, nickel, palladium, boron, chromium, silicon, germanium, aluminum, iron, cobalt, manganese, titanium, tin, gallium, vanadium, indium, phosphorus, molybdenum, platinum, zinc, or combinations thereof. During an operation in which the tool 100 is exposed to high temperatures, the steel base 200 and the carbide segment 203, having different coefficients of thermal expansion, may expand and contract at different rates, weakening the bond between the base 200 and the carbide segment 203 and thereby weakening the tool 100. A surprising result shows that by forming the at least one interruption 400 in the interfacial surface 204 of the base 200, the braze bond maintains its strength and thereby the life of the tool 100 increases. A superhard tip 206 may be bonded to the cemented metal carbide segment 203. In some embodiments, the tip 206 may have a diameter larger than an upper diameter of the carbide segment 203 such that the tip 206 overhangs the carbide segment 203 at a surface 401 in which they are bonded together. It is believed that an overhang 470 formed between the tip 206 and the carbide segment 203 may increase the life of the tip during operation. The at least one interruption 400 may comprise a width 451 of 5 to 75 percent the diameter 452 of the interfacial surface of the base 200. The interruption 400 may also comprise a depth 450 of 5 to 75 percent of height 453 of a body portion 460 of the base. In the embodiment of FIG. 4, the carbide segment may comprise a concave surface 480 and a body portion of the base 200 may comprise a concave surface 481.

Figure 5:
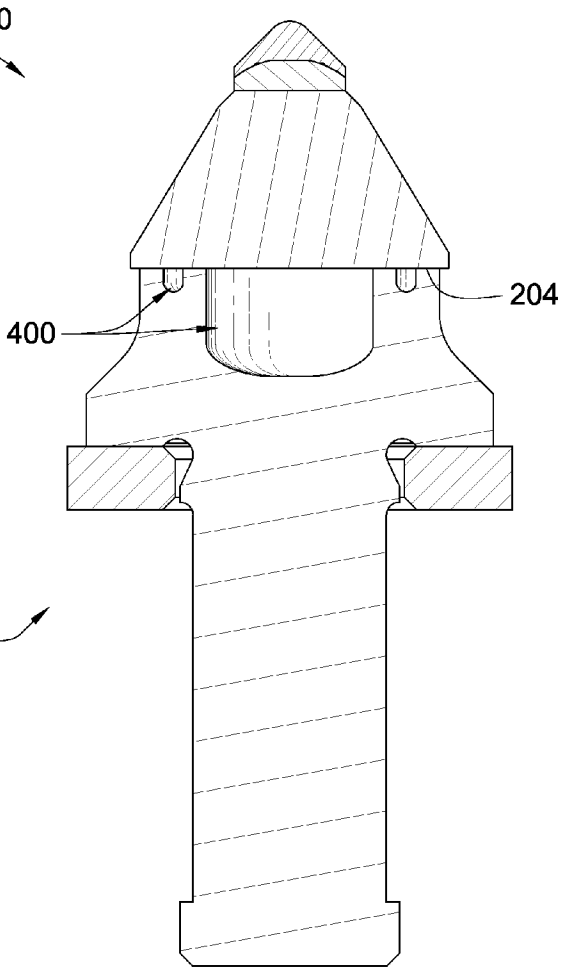
FIG. 5 is a cross-sectional diagram of another embodiment of an attack tool.

In FIG. 5, a plurality of interruptions 400 may be formed in the interfacial surface 204 of the base 200. The interruptions 400 may extend into the base at various depths and have various widths. The interruptions may be substantially coaxial. The interruption depths may be formed into the base such that the interruptions provide the strength to the tool while maintaining its structural integrity during an operation.

Figure 6:
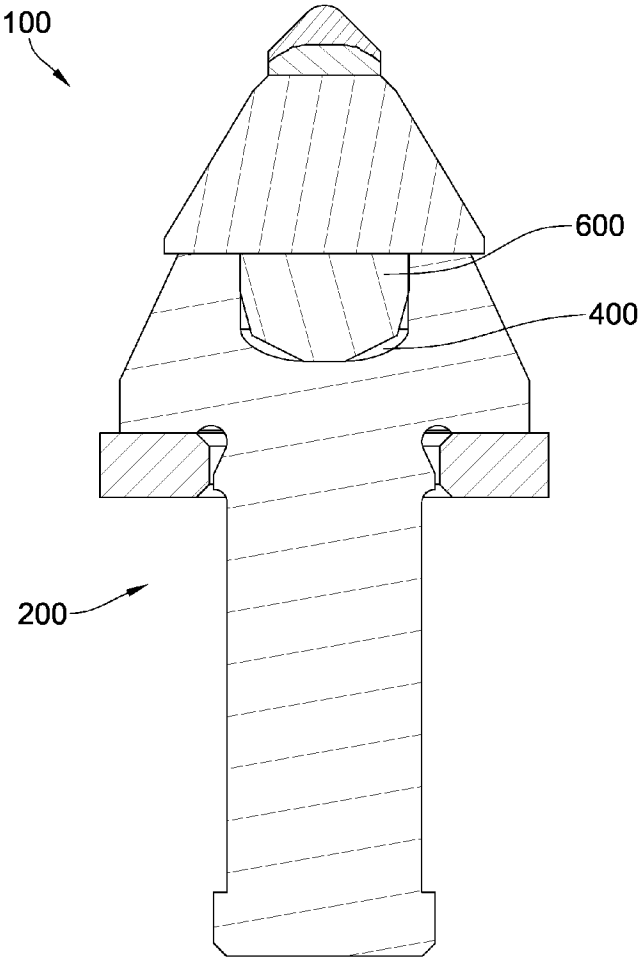
FIG. 6 is a cross-sectional diagram of another embodiment of an attack tool.

In some embodiments, a supporting piece 600 may be press-fit into the interruption 400, as shown in the embodiment of FIG. 6. The supporting piece 600 may comprise a hard material such as carbide, chromium, tungsten, tantalum, niobium, titanium, molybdenum, natural diamond, polycrystalline diamond, vapor deposited diamond, cubic boron nitride, TiN, AlNi, AlTiNi, TiAlN, CrN/CrC/(Mo, W)S2, TiN/TiCN, AlTiN/MoS2, TiAlN, ZrN, diamond impregnated carbide, diamond impregnated matrix, silicon bonded diamond, or combinations thereof. The supporting piece 600 may help to strengthen the steel base 200. The supporting piece may be press fit into the interruption. The press fit may comprise an interference of 0.0005 to 0.0050 inches. It is believed that a press fit supporting piece may limit the shrinkage of the interfacial surface during a cooling step in the brazing process.

Figure 7:
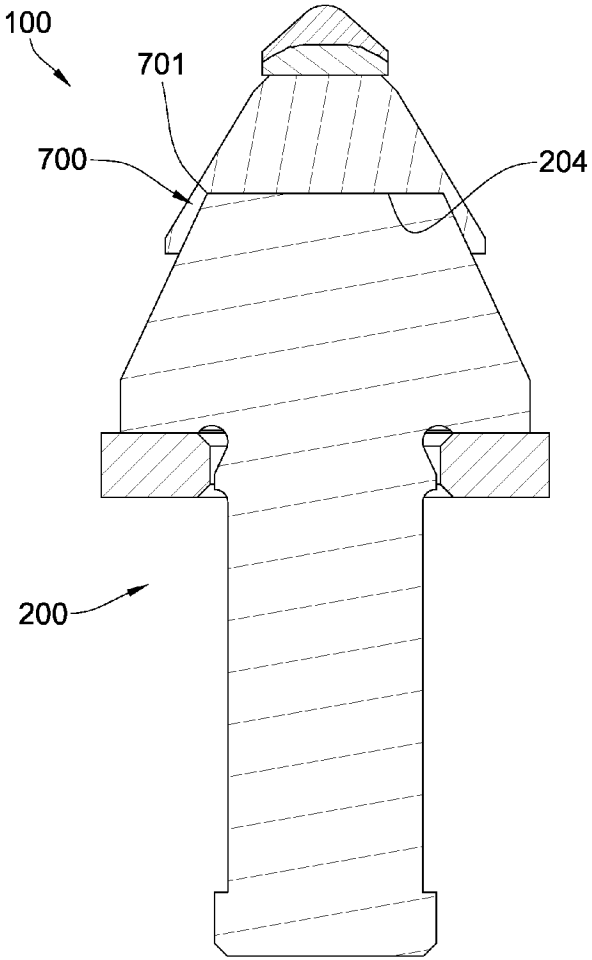
FIG. 7 is a cross-sectional diagram of another embodiment of an attack tool.

In some embodiments, a portion 700 of the base 200 may be inserted into a pocket 701 formed within the carbide segment 203. In the embodiment of FIG. 7, the base 200 may not have an interruption formed in the interfacial surface 204. However, in the embodiment of FIG. 8, the base 200 may have an interruption 400 formed in the interfacial surface 204. The tool 100 may comprise an overhang 205 in which the base diameter of the carbide segment 203 may overhang the diameter of the interfacial surface 204 by a distance 800 of 0.001 to 0.100 inch.

Figure 9:
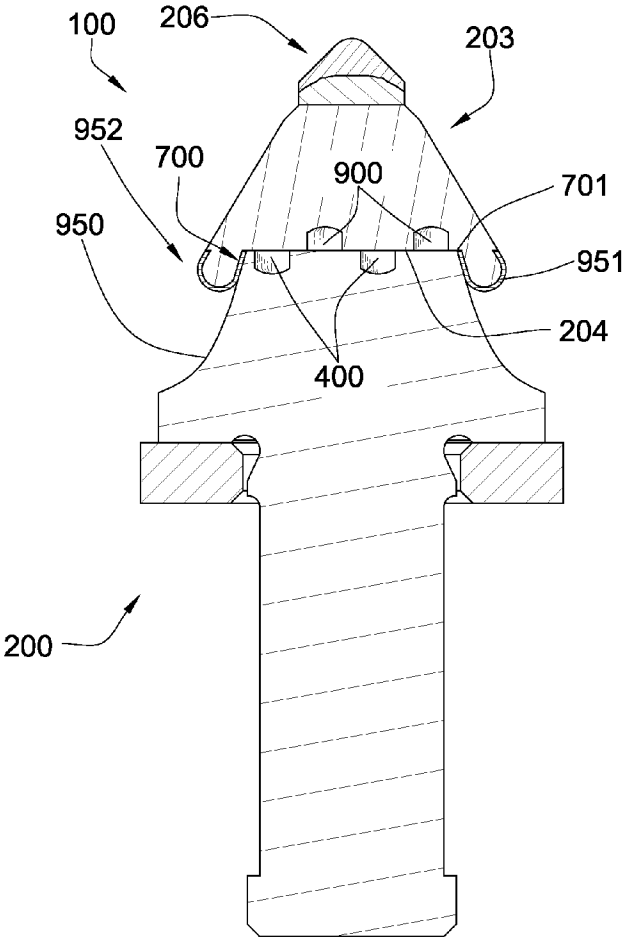
FIG. 9 is a cross-sectional diagram of another embodiment of an attack tool.
Figure 8:
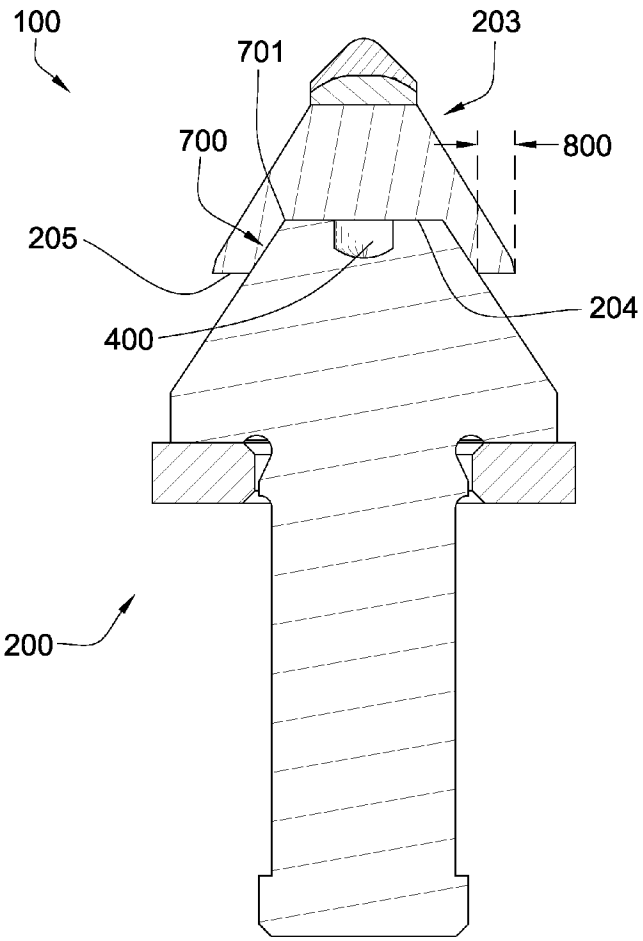
FIG. 8 is a cross-sectional diagram of another embodiment of an attack tool.

FIG. 9 shows an embodiment with a plurality of interruptions 400 disposed in the interfacial surface 204 as well as a plurality of interruptions 900 disposed within the planar end of the cemented metal carbide segment 203. In this embodiment, the base 200 may have a concave surface 950. In this embodiment, the overhanging carbide portion 952 may comprise a convex region. In other embodiments, the overhanging carbide portion may comprise a concave region. The overhanging carbide portion 952 may also be coated with a stop-off material 951 such that the braze used to bond the metal carbide segment 203 and the base 200 together does not contact the overhang portion 952 or a portion of the carbide segment proximal the superhard tip 206. The stop-off 951 may comprise boron nitride, copper, nickel, cobalt, gold, silver, manganese, magnesium, palladium, titanium, niobium, zinc, phosphorous, boron, aluminum, cadmium, chromium, tin, silicon, tantalum, yttrium, metal oxide, ceramic, or combinations thereof. It may be beneficial to coat the overhang with a stop-off such that the stop-off material resists excess braze that may flow from the interfacial surface between the carbide segment and the base.

Figure 10:
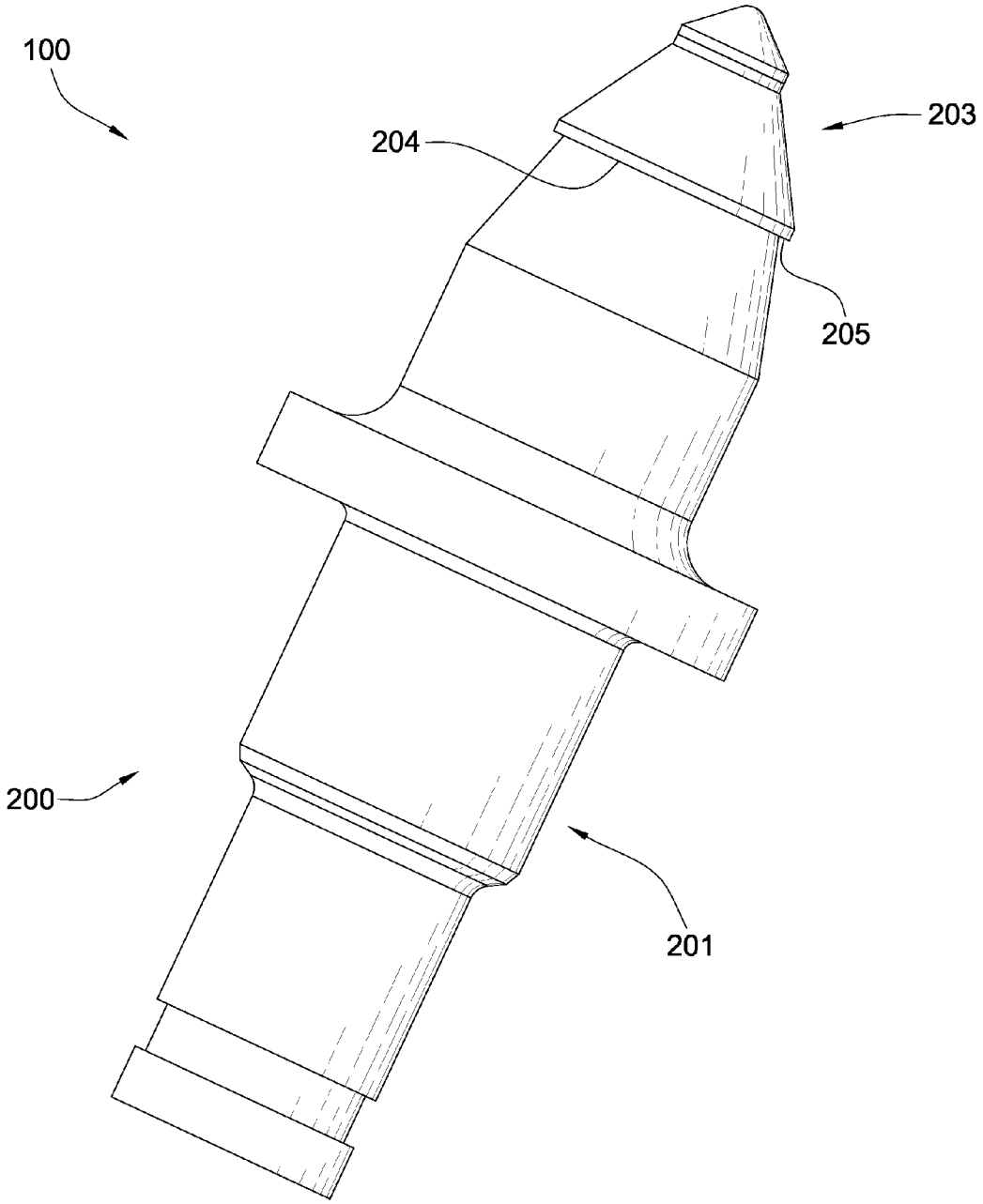
FIG. 10 is a perspective diagram of another embodiment of an attack tool.

FIG. 10 discloses an attack tool 100 with a wear-resistant steel base 200 having a shank 201 adapted for attachment to a trenching machine. The interfacial surface 204 of the base 200 may have a diameter smaller than the base diameter of the carbide segment 203, forming an overhang 205. The diameter of the carbide segment 203 may overhang the diameter of the interfacial surface 204 by 0.001 to 0.100 inch.

Figure 11:
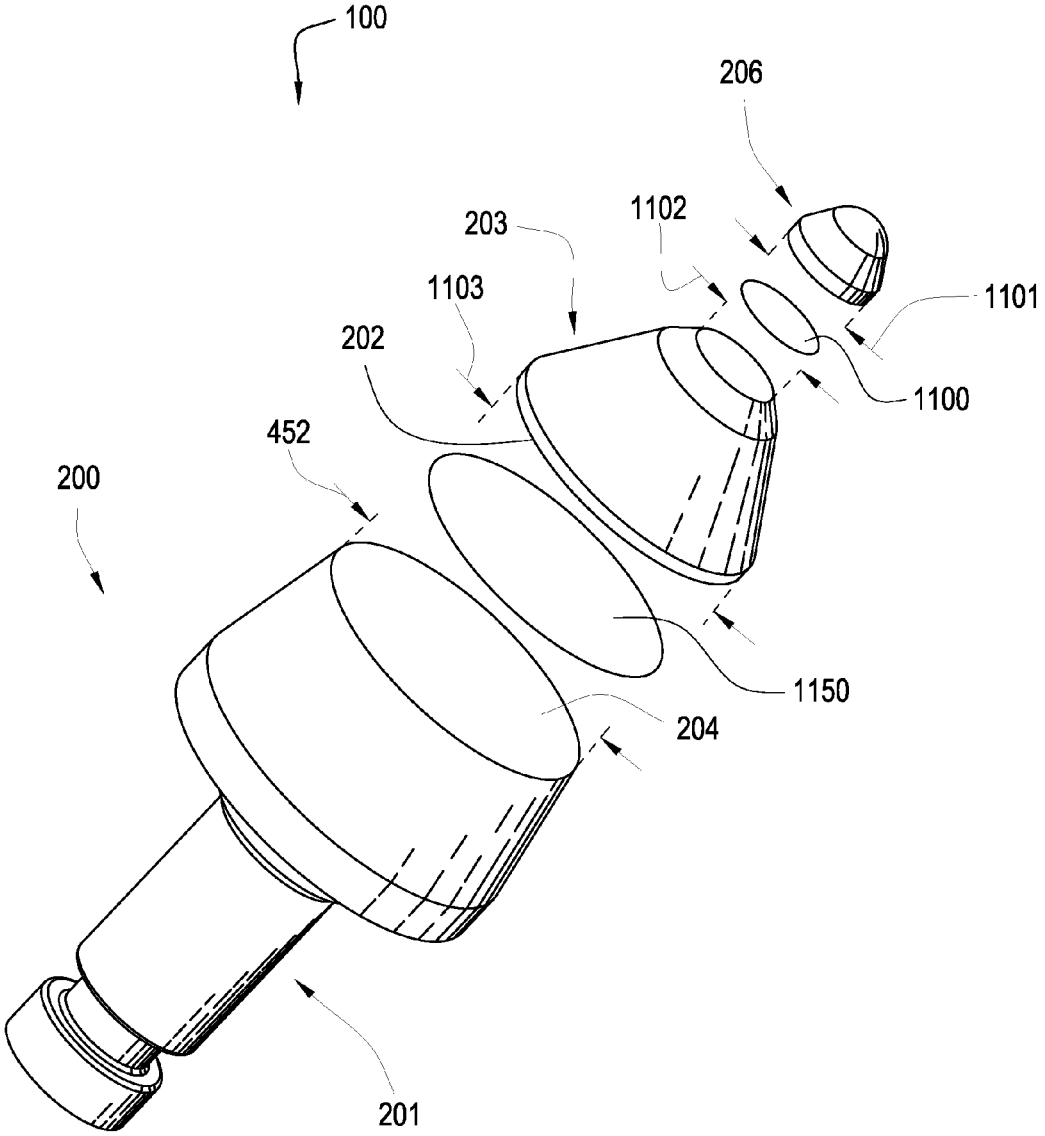
FIG. 11 is an exploded perspective diagram of an embodiment of an attack tool.

FIG. 11 is an exploded perspective diagram of an embodiment of an attack tool 100. The attack tool 100 comprises a wear-resistant base 200 suitable for attachment to a driving mechanism and a cemented metal carbide segment 203. A planar end 202 of the carbide segment 203 may be bonded to the interfacial surface 204 of the base 200 axially opposed to the shank 201. The bond between the carbide segment 203 and the base 200 may be a braze 1150 comprising silver, gold, copper, nickel, palladium, boron, chromium, silicon, germanium, aluminum, iron, cobalt, manganese, titanium, tin, gallium, vanadium, indium, phosphorus, molybdenum, platinum, zinc, or combinations thereof. The braze 1150 may comprise a thickness of 0.001 to 0.010 inch. A superhard tip 206 may be bonded to the carbide segment 203. The tip 206 may be brazed to the carbide segment 203 with a braze 1100 having a thickness of 1.0 to 10 microns. The tip 206 may also have a diameter 1101 that is larger than an upper diameter 1102 of the carbide segment 203. The interfacial surface 204 of the base 200 may have a diameter 452 smaller than a base diameter 1103 of the carbide segment 203. The base diameter 1103 may overhang the diameter 452 of the interfacial surface 204 by 0.001 to 0.100 inch. In some embodiments, the outside diameter of the carbide segment 203 may be grinded down 0.010 to 0.050 inch. It is believed that grinding down the outer diameter may increase the life of the attack tool 100.

Figure 12:
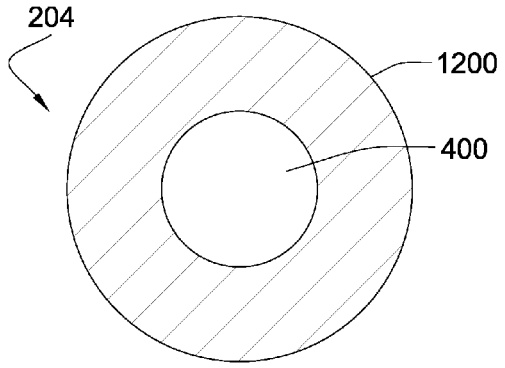
FIG. 12 is a sectional diagram of an embodiment of an interfacial surface of a base of an attack tool.
Figure 13:
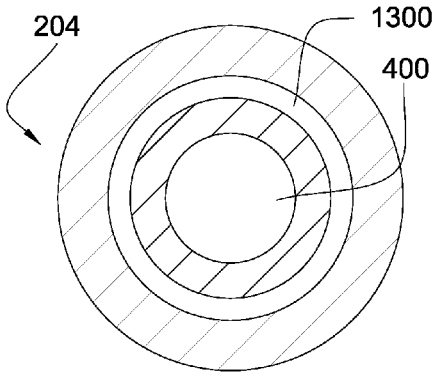
FIG. 13 is a sectional diagram of another embodiment of an interfacial surface of a base of an attack tool.
Figure 14:
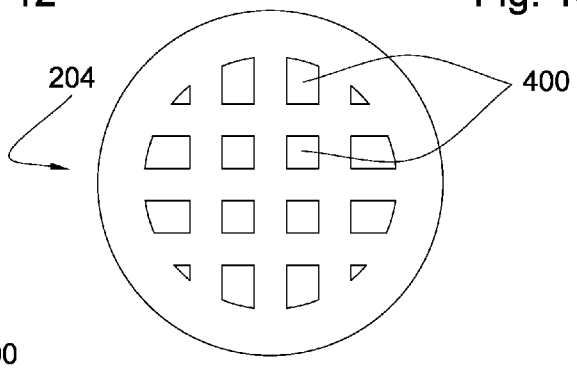
FIG. 14 is a sectional diagram of another embodiment of an interfacial surface of a base of an attack tool.
Figure 15:
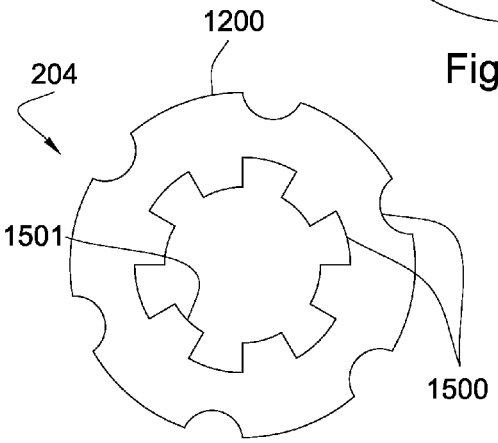
FIG. 15 is a sectional diagram of another embodiment of an interfacial surface of a base of an attack tool.
Figure 16:
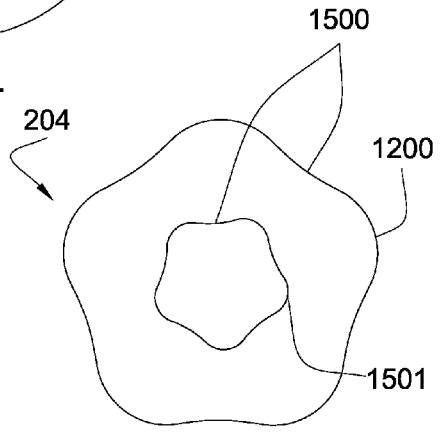
FIG. 16 is a sectional diagram of another embodiment of an interfacial surface of a base of an attack tool.

Various sectional diagrams of embodiments of the interfacial surface 204 of the base are shown in FIGS. 12 through 16. In FIG. 12, an interruption 400 may be formed in the interfacial surface 204, the interruption 400 being concentric with an outer diameter 1200 of the surface 204. In some embodiments, a plurality of interruptions may be formed in the interfacial surface. Referring now to FIG. 13, the interruption 400 may be concentric with a second interruption 1300. The interruptions 400, 1300, comprise circular geometries. FIG. 14 illustrates another embodiment of the interfacial surface 204 having a plurality of interruptions 400. In this embodiment, the plurality of interruptions 400 may comprise rectangular geometries. In some embodiments, the at least one interruption 400 may have a plurality of notches 1500 formed within the interfacial surface 204. Such embodiments may be formed by forging, machining, or a combination thereof. FIG. 15 illustrates a plurality of notches 1500 formed within the outer diameter 1200 as well as an inner diameter 1501 of the interfacial surface 204. It is believed that during operation, the notches formed within the base may lower the stress imposed on the attack tool, thereby extending the life of the tool. FIG. 16 shows another embodiment of an interfacial surface 204 having a plurality of notches 1500 formed within the surface's outer and inner diameters 1200, 1501. In this embodiment, the notches 1500 may be gradual and less defined than the notches in the embodiment shown in the embodiment of FIG. 15.

Figure 17:
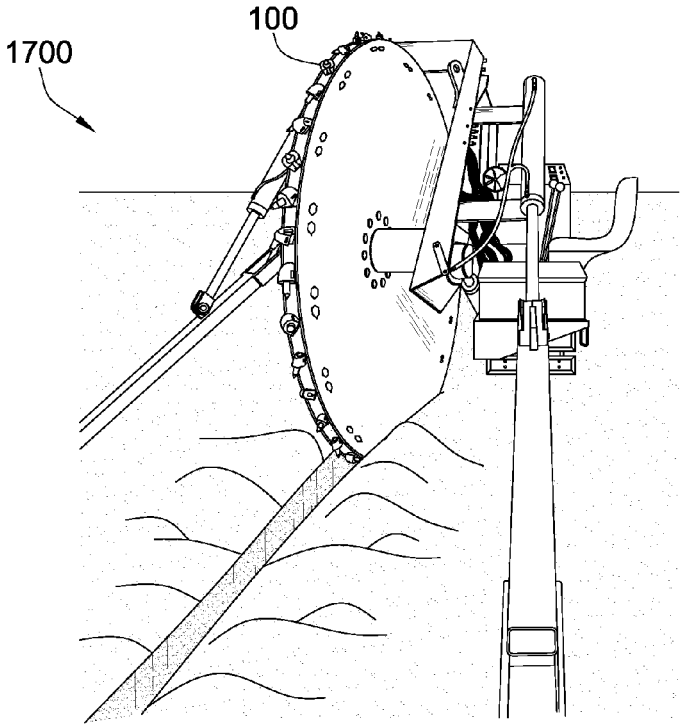
FIG. 17 is perspective diagram of an embodiment of a trencher.
Figure 18:
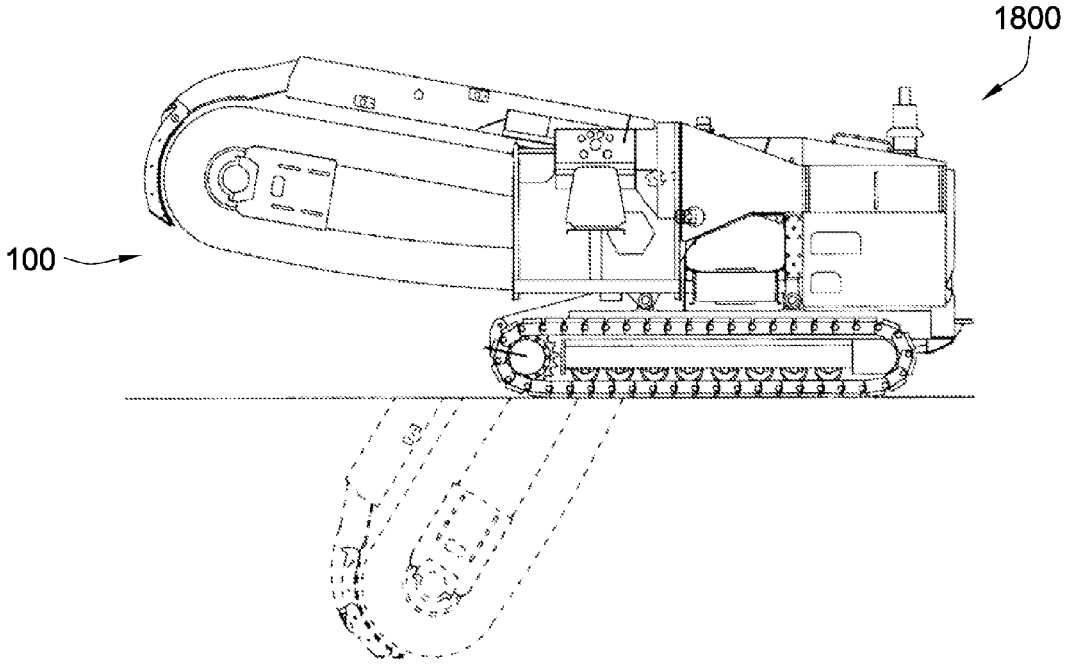
FIG. 18 is an orthogonal diagram of another embodiment of a trencher.

FIGS. 17 and 18 show various wear applications that may be incorporated with the present invention. Attack tools 100 may be disposed on a rock wheel trenching machine 1700 as shown in FIG. 17. Also, the attack tools 100 may be placed on a chain that rotates around an arm 1800 of a chain trenching machine 1700. This is shown in the embodiment of FIG. 18.

Figure 19:
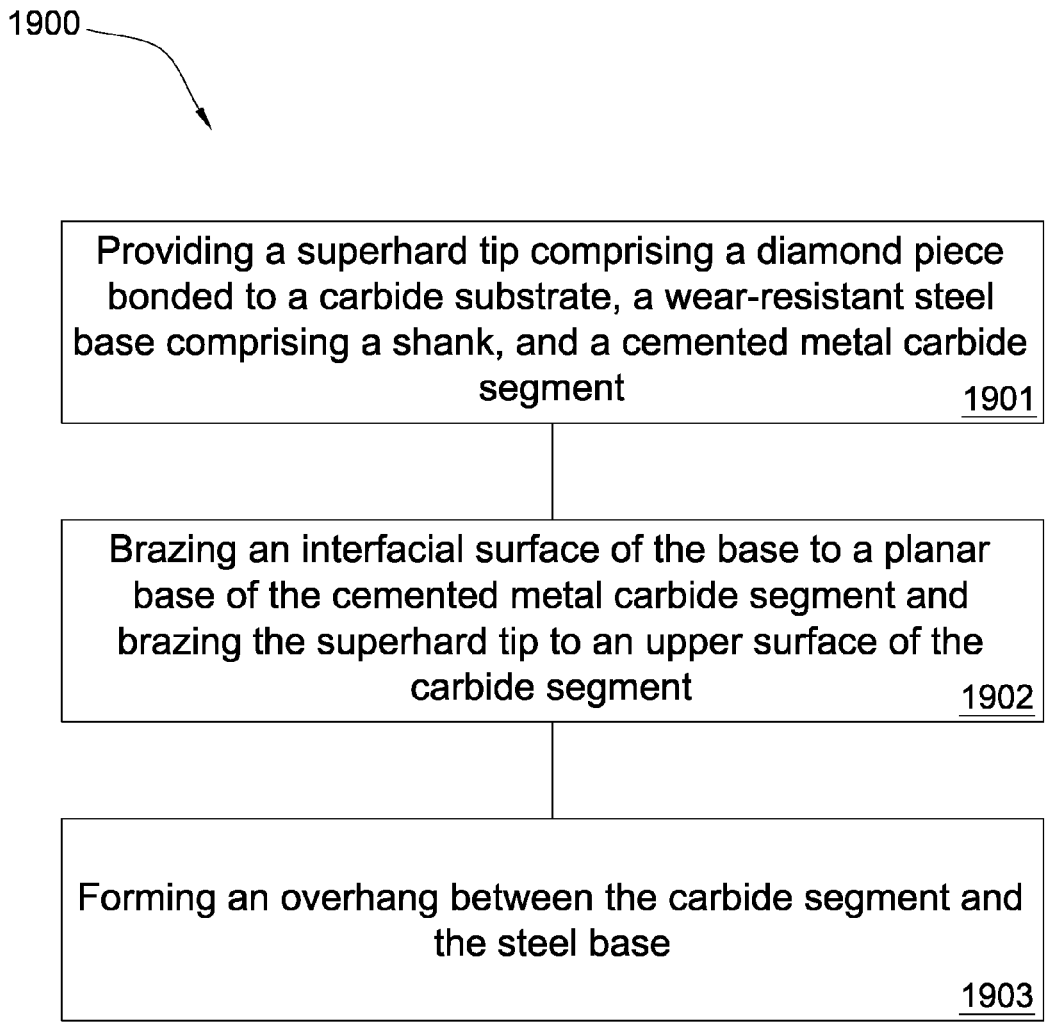
FIG. 19 is a diagram of an embodiment of a method for manufacturing an attack tool.

FIG. 19 is a diagram of an embodiment of a method 1900 for manufacturing an attack tool. The method 1900 includes providing 1901 a superhard tip comprising a diamond piece bonded to a carbide substrate, a wear-resistant steel base comprising a shank, and a cemented metal carbide segment. The method 1900 also includes simultaneously brazing 1902 an interfacial surface of the base to a planar base of the cemented metal carbide segment and brazing the superhard tip to an upper surface of the carbide segment. The method 1900 further includes forming 1903 an overhang between the carbide segment and the steel base.

Whereas the present invention has been described in particular relation to the drawings attached hereto, it should be understood that other and further modifications apart from those shown or suggested herein, may be made within the scope and spirit of the present invention.

What is claimed is:

1. A degradation tool, comprising:

a steel base comprising a shank for attachment to a driving mechanism and a first surface opposite the shank;

a carbide segment with an impact tip attached thereto for degrading a formation and a second surface opposite the impact tip;

wherein the first surface and the second surface are brazed together to form an interfacial surface;

at least one cavity formed in the first surface and interrupting the interfacial surface; and a smooth transition between the interfacial surface surrounding an opening of the at least one cavity and the second surface spanning the opening.

2. The tool of claim 1, wherein the at least one cavity comprises a plurality of notches formed within the first surface.

3. The tool of claim 1, wherein the at least one cavity comprises a width of 5 to 75 percent the diameter of the interfacial surface.

4. The tool of claim 1, wherein the at least one cavity comprises a depth of 5 to 75 percent a height of an upper portion of the base.

5. The tool of claim 1, wherein the interfacial surface is non-planar.

6. The tool of claim 1, wherein the second surface is planar across an opening of the at least one cavity.

7. The tool of claim 1, wherein the second surface is planar adjacent an opening of the at least one cavity.

8. The tool of claim 1, wherein the interfacial surface proximate the at least one cavity forms a planar ring around an opening of the at least one cavity.

9. The tool of claim 1, wherein the interfacial surface surrounding an opening of the at least one cavity is continuous with the second surface spanning the opening.

10. The tool of claim 1, wherein the at least one cavity is centered on the first surface.

11. The tool of claim 1, wherein the at least one cavity comprises a substantially tapering cross-sectional area.

12. The tool of claim 1, further comprising at least one cavity formed in the second surface and interrupting the interfacial surface.

13. The tool of claim 1, further comprising stop-off material limiting the interfacial surface.

* * * * *